US006086428A

United States Patent [19]

Pharney et al.

[11] Patent Number: 6,086,428

[45] Date of Patent: Jul. 11, 2000

[54] CROSSTALK COMPENSATION FOR CONNECTOR JACK

[75] Inventors: Julian Robert Pharney, Indianapolis, Ga.; David Louis Reed, New Palestine; William Tracy Spitz, Indianapolis, both of Ind.

[73] Assignee: Lucent Technologies Inc., Murray Hill, N.J.

[21] Appl. No.: 09/047,870

[22] Filed: Mar. 25, 1998

[51] Int. Cl.[7] ..... H01R 23/02

[52] U.S. Cl. ..... 439/676; 439/941

[58] Field of Search ..... 439/676, 941

[56] References Cited

U.S. PATENT DOCUMENTS

| | | | |
|---|---|---|---|
| 4,210,376 | 7/1980 | Hughes et al. | 339/17 LC |
| 4,699,595 | 10/1987 | Nakazawa et al. | 439/676 |
| 5,145,401 | 9/1992 | Archer | 439/395 |
| 5,186,647 | 2/1993 | Denkmann et al. | 439/395 |
| 5,226,835 | 7/1993 | Baker, III et al. | 439/403 |
| 5,601,447 | 2/1997 | Reed et al. | 439/941 |
| 5,647,770 | 7/1997 | Belopolsky | 439/676 |
| 5,674,093 | 10/1997 | Vaden | 439/676 |
| 5,700,167 | 12/1997 | Pharney et al. | 439/676 |
| 5,716,237 | 2/1998 | Conorich et al. | 439/941 |

FOREIGN PATENT DOCUMENTS

| | | | |
|---|---|---|---|
| 0 899 826 A2 | 3/1999 | European Pat. Off. | H01R 23/00 |
| PCT/DK94/00107 | 3/1994 | WIPO | H01R 13/71 |

*Primary Examiner*—Neil Abrams
*Assistant Examiner*—J. F. Duverne

[57] ABSTRACT

A crosstalk compensating connector jack assembly has a dielectric spring block having a staggered configuration of lead frames. The conductors of one of the lead frames are maintained at a first level in the block and the conductors of a second one of the lead frames are maintained at a second level within the block. The two levels are spaced apart a distance that permits the formation of interacting inductive loops. For at least two pairs of conductors, one of the conductors is in the first lead frame and the other conductor is in the second lead frame, thereby forming two inductive loops which interact with each other to reduce crosstalk. The spring block is made of two substantially identical halves adapted to be latched together to hold the conductors in place.

16 Claims, 6 Drawing Sheets

| | NEXT BETWEEN PAIRS | | | | | | POWER SUM | | | |
|---|---|---|---|---|---|---|---|---|---|---|
| | PAIR I - II | PAIR I - III | PAIR I - IV | PAIR II - III | PAIR II - IV | PAIR III - IV | PAIR I | PAIR II | PAIR III | PAIR IV |
| | -dB | -dB | -dB | -dB | -dB | -dB | -dB | -dB | -dB | -dB |
| 657C JACK | 47.2 | 34.9 | 43.3 | 45.8 | 68.3 | 63.4 | 34.1 | 43.5 | 34.6 | 43.2 |
| STAGGER JACK | 48.7 | 47.3 | 44.4 | 42.5 | 62.2 | 47.6 | 41.6 | 41.5 | 40.3 | 42.6 |

*FIG. 9*

CROSSTALK COMPENSATION FOR CONNECTOR JACK

FIELD OF THE INVENTION

This invention relates to reduction of crosstalk in telecommunication systems and, more particularly, to the reduction of crosstalk occurring in connectors and connector jacks used in such systems.

BACKGROUND OF THE INVENTION

Telecommunications and data transmission systems have evolved in recent years which are designed to accommodate not only greater numbers of users, but also higher data rates, as a consequence of the use of higher and higher frequencies and huge increases in signaling traffic. Although present day cables and wiring can, theoretically, handle such increased frequencies and traffic volume, the wiring paths themselves become, in effect, antennae which both radiate and receive electromagnetic radiation, thereby creating crosstalk problems. This crosstalk problem is aggravated when station hardware requires multiple wire-pairs. Signal coupling (crosstalk) between different pairs of wires is a source of interference that degrades the capabilities of the apparatus to process incoming signals. This is manifested quantitatively as decreased signal-to-noise ratio and, consequently, increased error rate in the signal processing. As the necessary increases in frequency are implemented, the crosstalk problem becomes of increasingly significant concern.

Various expedients have been used for reducing crosstalk in cables, such as shielding individual pairs, helically winding twisted pairs, or, where possible, increasing the physical separation of one pair from another. However, crosstalk also occurs in station hardware and its connection to the cable or cables. For reasons of economy, convenience, and standardization, it is desirable to extend the utility of the station hardware components, especially plugs and jacks, to higher and higher frequencies or data rates while minimizing any departure from established standard components. Unfortunately, the plugs and jacks that are most commonly used in interconnecting cables and hardware, such as distribution modules, generally include up to eight wires (four pairs) that are necessarily oriented both parallel and close together, a condition that leads to excessive crosstalk, even over short distances, and which is exacerbated as the frequency of the signals or the data rate is increased. Thus, inasmuch as the plugs and jacks generally meet ANSI/EIA/TIA standards for wire and terminal connections, undesired and often unacceptable crosstalk is produced.

There have been numerous attempts to design, within the parameters of standardization, components which reduce crosstalk. In U.S. Pat. No. 5,186,647 of Denkmann et al., there is shown an electrical connector arrangement specifically aimed at reducing crosstalk without drastically altering the general configuration of a standard connector. The connector of that patent comprises a number of input and output terminals interconnected by a pair of lead frames mounted on a dielectric spring block. Each lead frame comprises a plurality of flat, elongated conductors each being terminated by a spring contact at one end and an insulation displacement connector at the other end. In accordance with ANSI/EIA/TIA 568 standard, the terminal assignment for what is designated wire pair I (terminals 4 and 5) is straddled by the terminal assignment for wire pair III (terminals 3 and 6), a condition which produces especially troublesome crosstalk. In order to compensate for, or to diminish, this crosstalk, three of the conductors of one lead frame overlap three of the conductors of the other lead frame within a designated crossover region, thereby inducing compensating crosstalk among specific ones of the conductors occurring in use. Even though such an arrangement has been found to function quite well in reducing crosstalk, it does necessitate some modification of existing hardware, and thus represents an added expense. As a consequence, other solutions to the crosstalk problem have been sought. In U.S. Pat. No. 5,674,093 of Vadeu there is shown an electrical connector arrangement wherein the spring contacts, which normally are parallel to each other, are made non-parallel between their free ends and the major bend characteristic of most connector spring contacts. Because the adjacent contacts are not parallel to each other, the crosstalk inducing capacitance therebetween is reduced, thus producing a reduced crosstalk characteristic. Also, where alternate ones of the contacts have the same shape, there is a capacitive de-coupling effect. Such an arrangement materially reduces crosstalk, but the especially troublesome crosstalk between pairs I and III (as explained hereinafter) is still too close to an undesirable or intolerable amount.

It has been found that the effect of the crosstalk coupling induced by the standard modular plug and jack interface can be reduced to a great extent by the judicious placement of conductors after they exit the modular jack so as to induce crosstalk signals of opposite phase to those which were induced inside the plug and jack. Such a judicious placement of the conductors can be accomplished by having the conductors exit from the modular jack to a printed wiring board, in which case the routing of the wires on the board can be such as to produce a net reduction in crosstalk. The circuit traces that form the pairs of conductors preferably are routed in a pattern that produces crosstalk opposite in polarity to the crosstalk produced in the jack and plug. In U.S. patent application Ser. No. 08/711,699 of Pharney et al., filed Sep. 6, 1996, there is shown and described a crosstalk compensation circuit board member for use with communications systems connector arrays, such as a distribution module. The circuit board member comprises a wiring board on which are printed conductive paths for each of the leads of the several (usually four) pairs in a connector jack, and the board may accommodate several such jacks. The conductive paths are routed in a manner to create facing inductive loops which, for greatest interaction, are substantially mirror images of each other to produce inductive interaction among the different pair combination. The conductive paths can also be routed to incorporate capacitive coupling as well as inductive coupling. Such an arrangement is highly effective in reducing the deleterious effects of crosstalk, however, while it is effective with standard plugs and jacks, it requires a particular, unique, circuit board configuration.

What is needed and is apparently not known in the prior art is an arrangement for achieving a net reduction in crosstalk without the necessity of drastic modification of one or more standardized components, unique circuit board configuration, or crosstalk compensating crossovers of different conductor pairs within one of the components such as the dielectric spring block connector jack.

SUMMARY OF THE INVENTION

The present invention is an arrangement for accomplishing these desired ends. More particularly, in a preferred embodiment of the invention, the dielectric spring block of the connector jack has a staggered configuration of the lead frames. Thus, in a four pair configuration, the leads of pair II (by convention, leads 1 and 2) are carried by, and pass through the spring block at a first, upper, level, and the leads of pair IV (by convention, leads 7 and 8) are carried by, and pass through the spring block, parallel to each other and to leads 1 and 2, at a second, lower level. For pair III (by convention leads 3 and 6) lead 3 is supported by, and passes through, the spring block at the second (lower) level, and lead 6 is supported by, and passes through, the spring block at the first, upper level. Thus, leads 3 and 6 are staggered relative to each other. The leads of pair I (by convention leads 4 and 5) are likewise staggered relative to each other, with lead 4 being at the first level and lead 5 being at the second level. The dielectric spring block is comprised of two substantially identical bottom and top parts, each having spaced upstanding ridges or lands and grooves or valleys therebetween. The lands of the bottom part support the leads in the first level, and the grooves support the leads in the second level. The lands of the top part are spaced to fit between the lands or ridges of the bottom part and bear against the leads in the second level, while the bottoms of the valleys in the top part bear against the leads in the first level. Thus, when the top and bottom parts are mated, the leads are held firmly in place.

In operation, the staggered spacing of leads 3 and 6 (Pair III ) creates an inductive loop between those leads, and the staggered spacing of leads 4 and 5 (Pair I) creates an inductive loop between those leads. As is disclosed in the aforementioned Pharney et al. application Ser. No. 08/711, 699, the effect of facing inductive loops which are positioned to interact with each other, both inductively and capacitively, is the generation of compensating crosstalk between Pairs I and II which reduces the total effective crosstalk therebetween. As a consequence, crosstalk no longer degrades the signal transmission to the point where the signal has an overly large error ratio. In that application it is pointed out that the inductive loops, for maximum effect, should be mirror images of each other. In the present invention, the loops are not mirror images, but they are in sufficient proximity to each other to achieve a high degree of crosstalk compensation through their inductive and capacitive interaction.

The staggered arrangement of the lead frames in the spring block of the present invention achieves the desired end of lower crosstalk without alteration or modification of any other parts of the apparatus in which the spring blocks are used, such as, for example, a distribution module and, further, without the necessity of cross-overs. Also, the leads bring compensation means closer to the source, which is the plug, thereby increasing efficiency. Various other features and advantages of the present invention will be more readily understood from the following detailed description, read in conjunction with the accompanying drawings.

DESCRIPTION OF THE DRAWINGS

FIG. 9 is a table comparing measured values of near end cross talk for a standard spring block or jack and the staggered spring block or jack of the present invention.

DETAILED DESCRIPTION

Figure 1:
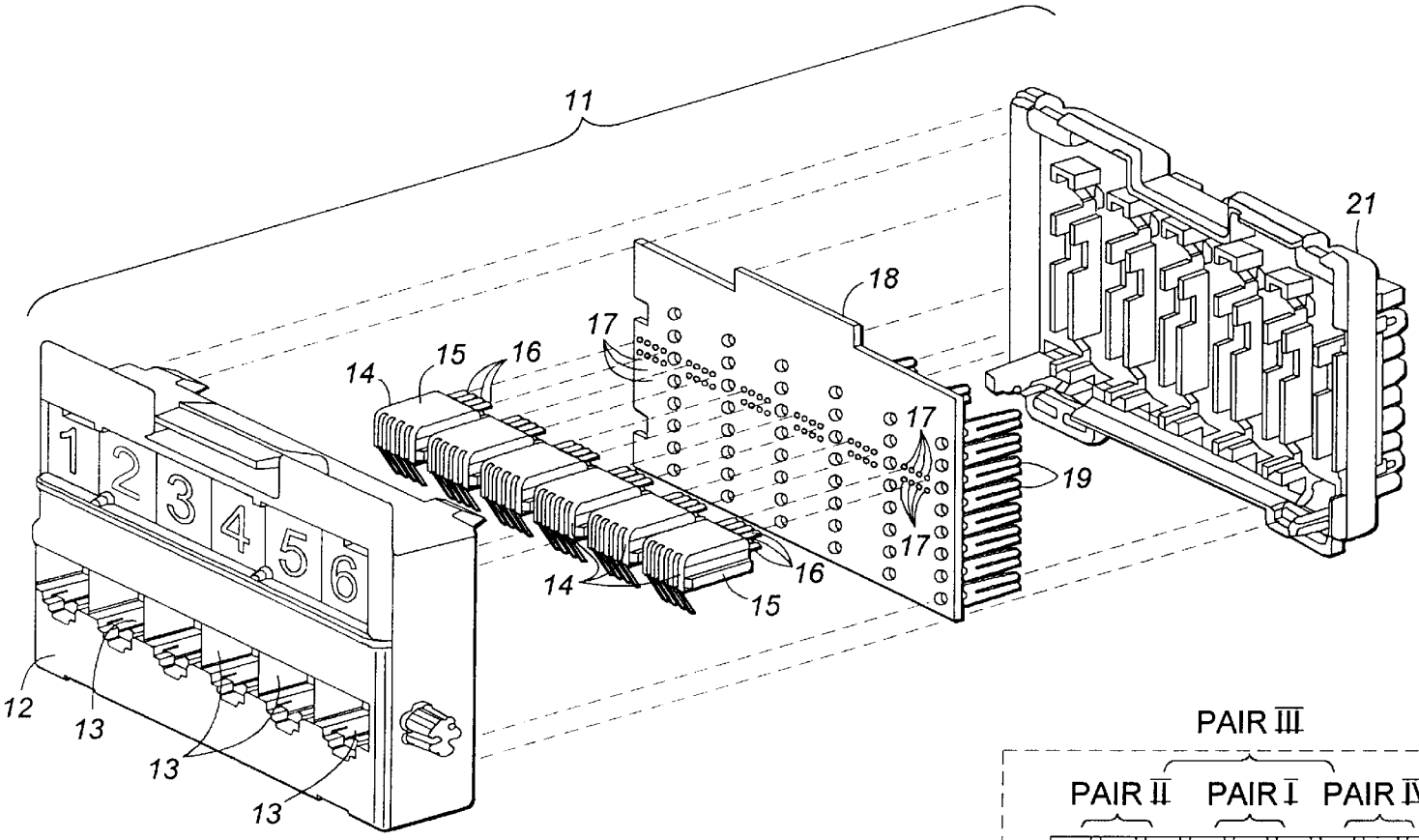
FIG. 1 is an exploded perspective view of a patch distribution module with which the spring block of the present invention is used.
Figure 2:
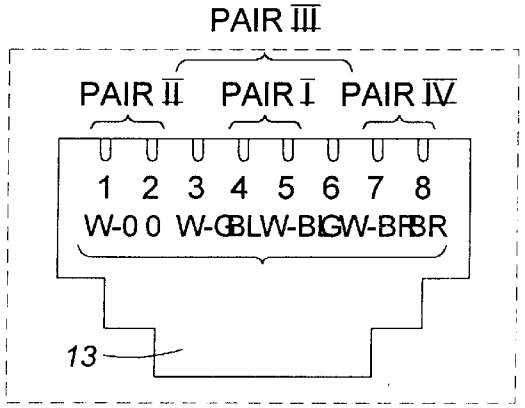
FIG. 2 is a diagrammatic view of one of the jack frame openings of the module of FIG. 1; illustrating the standard conductor pair orientation.

In FIG. 1 there is shown a patch panel distribution module 11 which comprises a front housing 12 having a plurality of apertures 13 for receiving standard modular plugs, not shown. Apertures 13 extend through housing member 12 and are adapted to receive, at the rear thereof, a plurality of connector jacks 14 which, when in place, connect to the modular plugs. In FIG. 2 there is shown a diagram of the positioning of the wires for, in this illustrative embodiment, four pairs of wires designated, for convenience, as pairs I, II, III, and IV. The standard convention for a four pair plug and jack connector has eight positions, as shown in FIG. 2, where one wire of pair II, for illustrative purposes the tip wire, occupies position 1 and the corresponding ring wire occupies position 2. The tip wire of pair I occupies position 5, and the corresponding ring wire occupies position 4. The tip wire of pair III occupies position 3 and the corresponding ring wire occupies position 6, thereby causing pair III to straddle pair I. The tip wire of pair IV occupies position 7 and the ring wire thereof occupies position 8. For the purposes of this discussion, the tip wire will be considered as positive going, or positive, and the ring wire will be considered as negative going, or negative. The wire placement convention shown in FIG. 2 obtains from the plug through the connector jacks 14, and it is in that portion of the arrangement of FIG. 1 where crosstalk is induced. The wiring shown in FIG. 2 is designated TIA/EIA 568A, type B. For TIA/EIA 568A, type A, wiring pairs II and III are interchanged. The remainder of this discussion is directed to Type B, for simplicity, although Type A can readily be used, the features of the invention being readily adaptable thereto. The connector jacks 14, which comprise a dielectric spring block 15 and the wire frames mounted therein, each have, in the four pair configuration, eight jack pins 16 protruding from the rear of the spring block 15 which are insertable into pin holes 17 in a circuit board 18. Board 18 is, in turn, connected by suitable means such as insulation displacement connectors 19 to the associated circuitry which, in FIG. 1, is represented simply by the rear member 21 of the distribution module 11 which contains such associated circuitry, such as cable connections. As pointed out hereinbefore, a large amount of undesirable crosstalk is generated in the modular plugs, and the wiring in the plug receptacles 13.

Figures 3A, 3B, 3C:
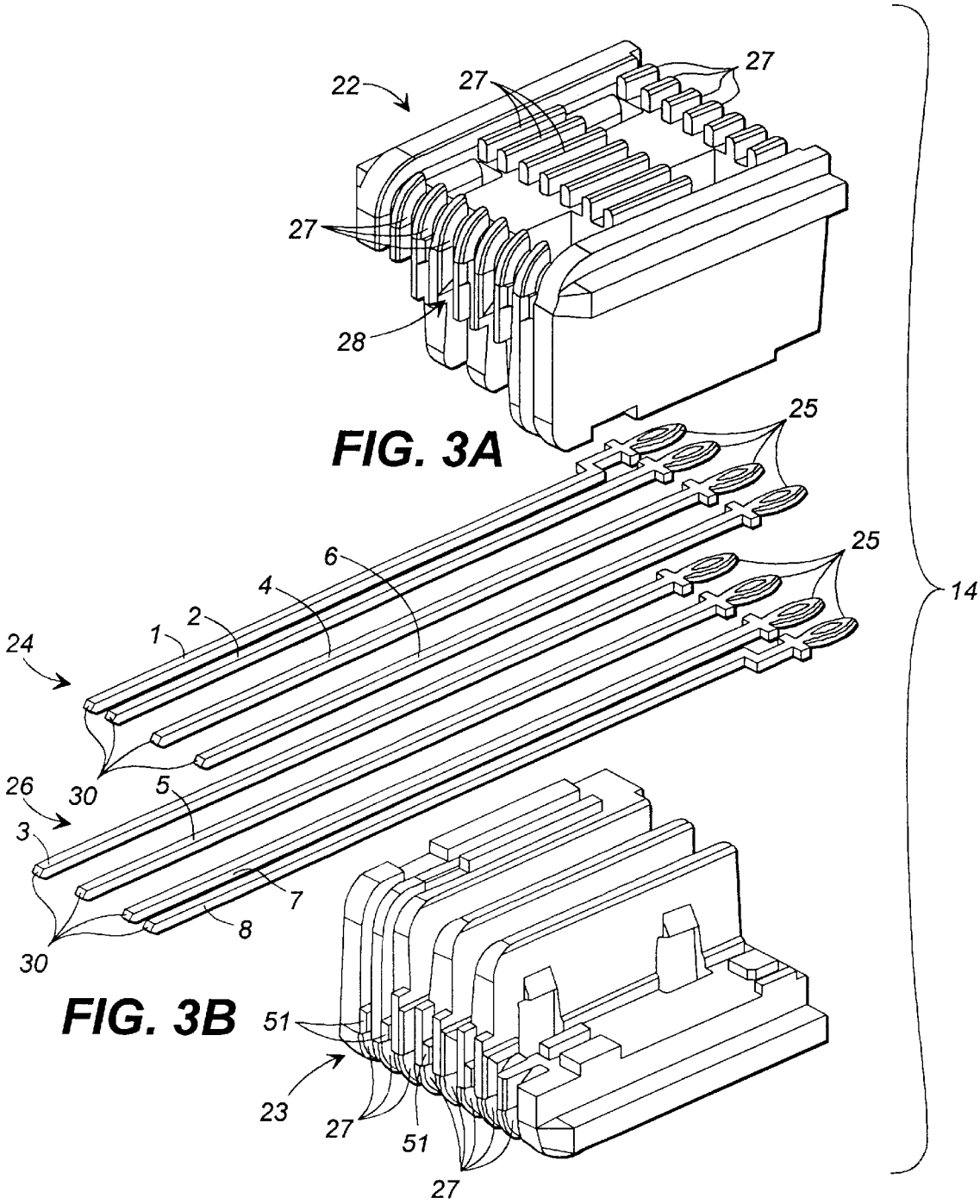
FIGS. 3A, 3B, and 3C together make up an exploded perspective view of the spring block assembly of the present invention.

The component parts of the present invention, in a preferred embodiment thereof, are shown in a perspective exploded view consisting of FIGS. 3A, 3B, and 3C, which form the component parts of the spring block 14 of the present invention. As can be seen, spring block 14 comprises four basic or component parts which are an upper dielectric block 22, a lower dielectric block 23, a first lead frame 24, and a second lead frame 26. The terms "upper" and "lower" refer only to orientation in the figures, and not necessarily to orientation in use. Upper block 22 and lower block 23 are substantially identical to each other and are designed to mesh together, as will be more apparent from reference to FIG. 4, as well as FIGS. 3A and 3C.

Observing the convention of FIG. 2, upper lead frame 24 comprises leads 1, 2, 4, and 6, and lower lead frame 26 comprises leads 3, 5, 7, and 8. Each of the leads terminates in a press fit eyelet member 25 for coupling the spring block assembly 14 to the board 18 through pin holes 17. The other ends 30 of the leads are as shown, i.e., unencumbered.

Figure 4A:
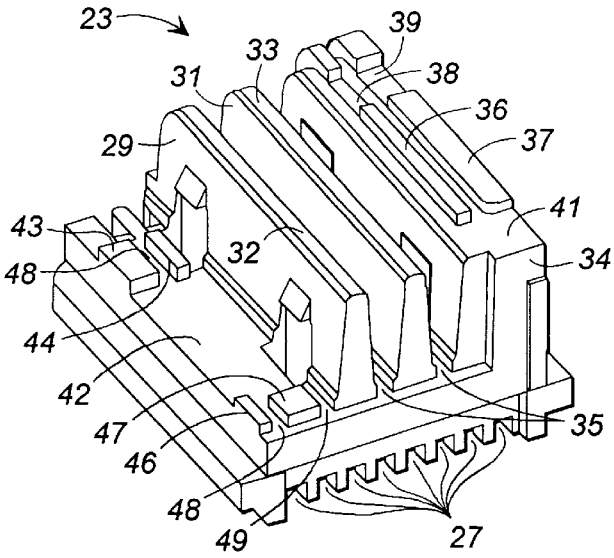
FIGS. 4A and 4B are perspective views of the two blocks which make up the dielectric block of the present invention.
Figure 4B:
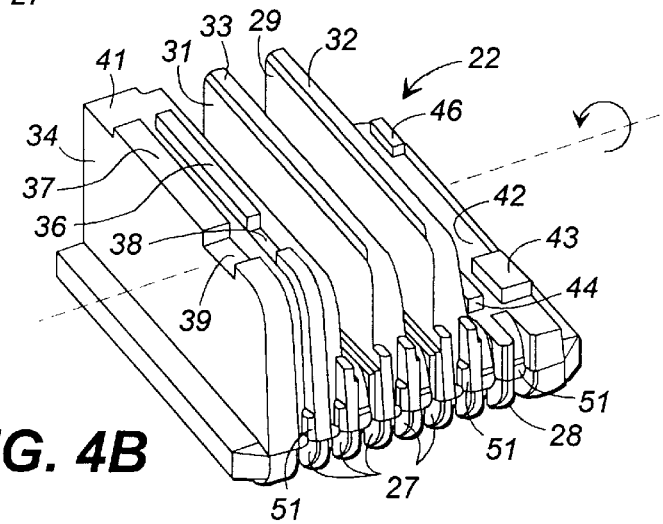

Upper block 22 has a plurality of parallel, longitudinally extending grooves 27 formed in the top thereof which continue down the front face 28 of block 22. On block 23, the grooves 27 are formed on the bottom thereof. It is, of course, understood that if block 23 were flipped over, it would then correspond to block 22, and vice versa. As best seen in FIGS. 4A and 4B, each block has first and second spaced upstanding ridges or lands 29 and 31, each having a flat, longitudinally extending upper surface 32 and 33, and a larger upstanding ridge or section 34 having longitudinally extending ridges 36 and 37 having notches 38 and 39 therein. Ridges 29, 31, and 34 are separated from each other by grooves 35 having conductor receiving surfaces. Ridges 36 and 37 do not extend to the end of blocks 22 and 23, thereby leaving a flat recessed portion 41 on section 34, as shown. Blocks 22 and 23 each have a planar portion 42 extending to the side of lands 29 upon which a raised, spaced projection 43 and 44 and 46 and 47, which form longitudinal grooves 48 and 49 for receiving conductor leads, as best seen in FIG. 5.

Figure 5:
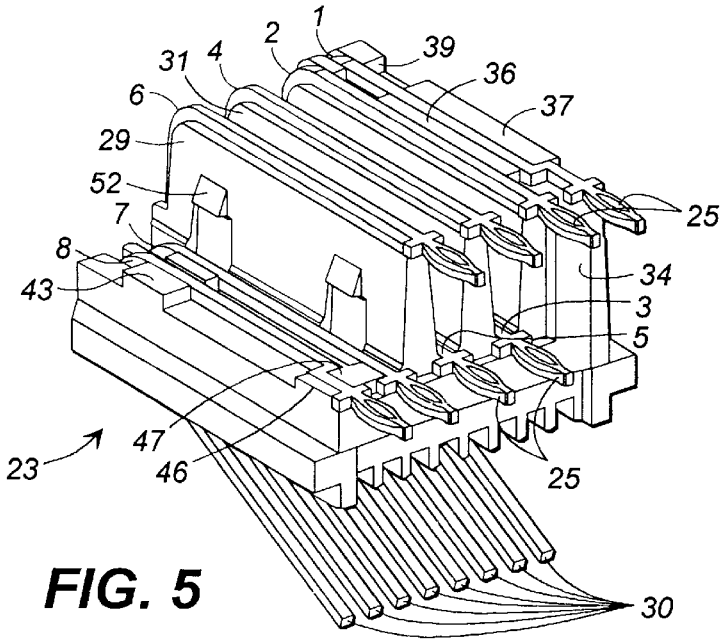
FIG. 5 is a perspective view of a stage in the assembly of the spring block of the present invention.
Figure 6:
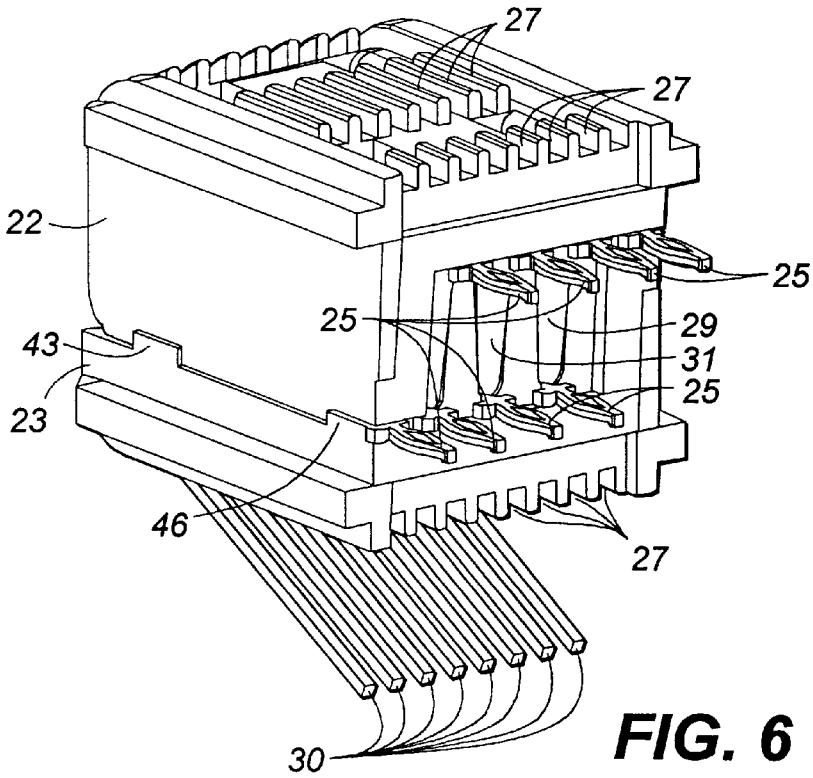
FIGS. 6 and 7 are perspective views of the rear and the front of the spring block assembly of the present invention.
Figure 7:
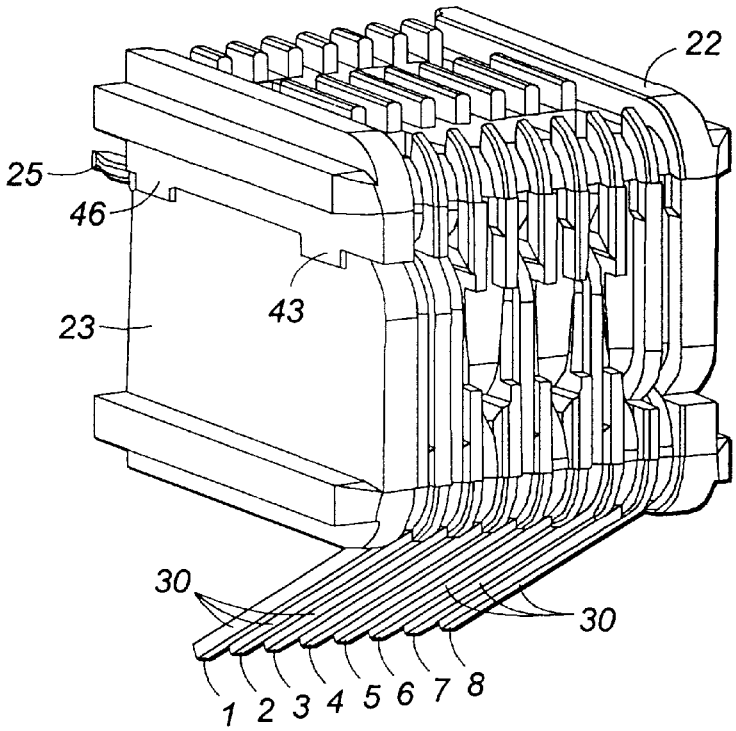

FIG. 5 represents the first stage in the assembly of spring block 14. As can be seen, lead 1 is placed in the groove formed between members 36 and 37 and lead 2 is placed on the top surface of member 34, spaced from lead 1 by projection 36. The leads are bent around the curved ends of the member 34 in the tracks 27 (best seen in FIG. 3C). Each of the tracks or grooves 27 has an aligning and holding projection 51 therein for facilitating alignment by the leads being wedged in their respective grooves. Lead 4 is positioned on the top longitudinal surface 33 of land 31 and bent in the same manner as leads 1 and 2, and lead 6 is positioned on the top of longitudinal surface 32 of land 29 and also bent to conform. Lead 3 is supported on a lower level in the groove formed between member 34 and land 31, and lead 5 is supported on the same lower level between lands 29 and 31, lead 7 is supported on the lower level by the surface 42 in the track or groove 49, and lead 8 is likewise supported by surface 42 in the groove or track 48. Each of leads 3, 5, 7, and 8 is bent around the front end of block 23 in the same manner as were leads 1, 2, 4, and 6 so that the ends 30 of the eight leads lie substantially in the same plane. As in the prior art, the free portions of the leads descend in a planar array, from front to back of block 23, at an angle thereto create spring contacts for mating with the plug inserted in one of the openings 13 (see FIG. 1). After the assembly stage shown in FIG. 5 is completed, block 22 rotated about a transverse axis, as shown in FIG. 4B, in the direction of the arrow. In other words, it is rotated end-to-end and mated with block 23. The notches 38 and 39 fit over projections 43 and 44, surface 41 bears against projections 46 and 48 and, as a consequence, leads 1, 2, and 7, 8 are maintained in place. Land surfaces 32 an d33 on block 22 bear against leads 3 and 5, and leads 4 and 6 are held in place by the bottoms of grooves between lands 29 and 31 of block 22 and between land 31 and member 34. FIG. 6 is a perspective view of the rear, or circuit board connection, end of the assembled plug or spring block 14, and FIG. 7 is a perspective view of the front, or jack plug connection, end of spring block 14. The two blocks 22 and 23 are held together by means of latching members 52, shown on block 23, which mate with openings 53 on member 34, and vice versa.

Figure 8:
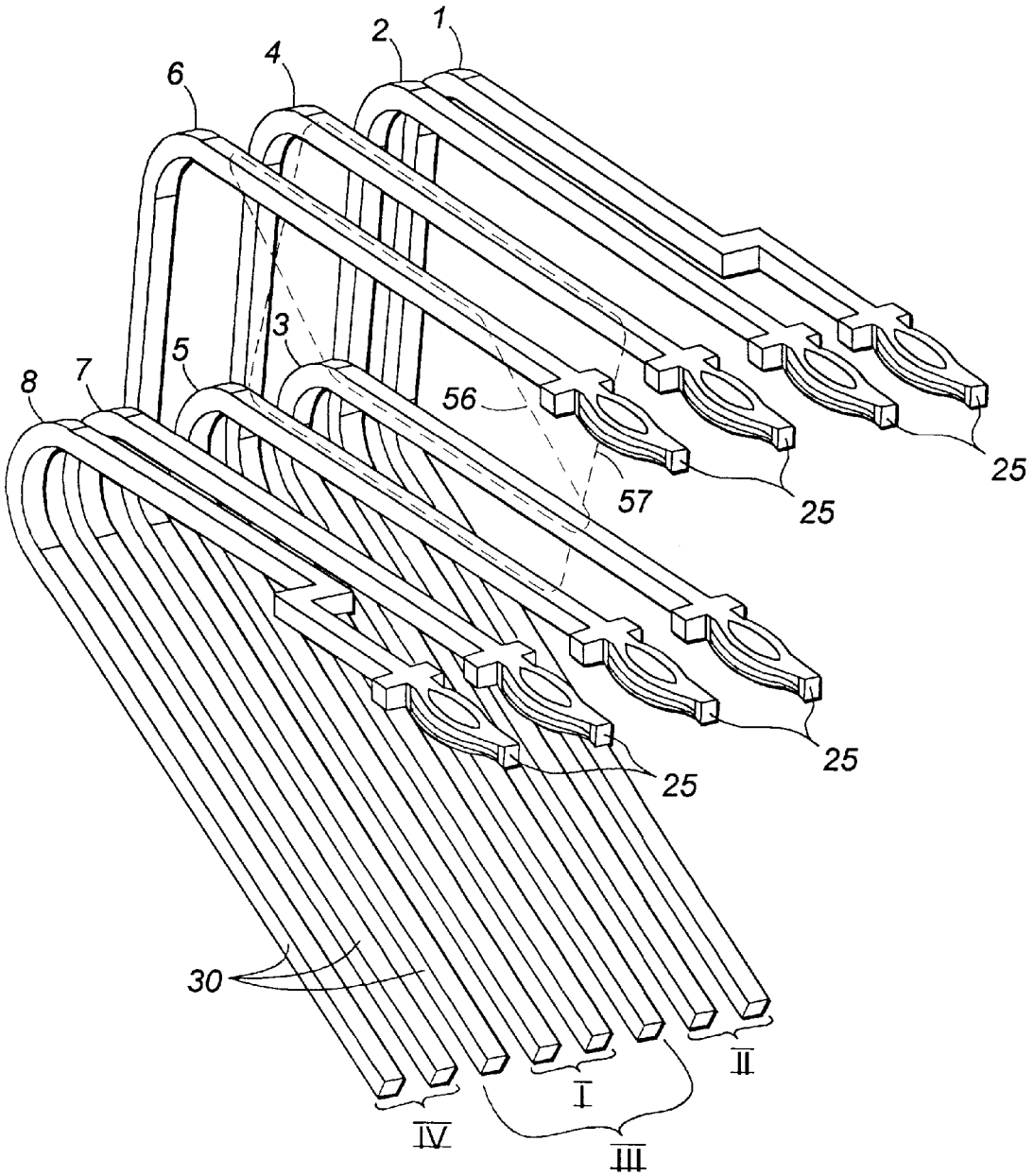
FIG. 8 shows the relationship of the springs and the region of effectively facing compensating loops of the I and III pair.

In FIG. 8 there is shown the various leads of the spring block assembly 14 and their orientation with respect to each other when mounted in the assembly 14 as shown in FIGS. 6 and 7. The staggered relationship of leads 3 and 6 (pair In) produces, when signals are present in the leads, an inductive loop 56 therebetween as shown by the dashed lines. In the same manner, inductive loop 57 is formed between leads 4 and 5 (pair I) as shown by the dash-dot lines. It can be seen that the two loops are close together, so that there is inductive and capacitive interaction between them. Although the loops 56 and 57 are not in parallel planes, which would produce the greatest interaction, the spacing of the first and second levels is such that there is substantial interaction and hence the generation of a significant amount of compensating crosstalk. This interaction produces in pairs I and III compensating crosstalk for counteracting the crosstalk existing between these pairs. If the existing crosstalk is negative, primarily generated in the plug, the coupling in the loops produces compensating positive cross-talk, thereby reducing the total crosstalk existing between pairs I and III. Because of the lead location convention shown in FIG. 2, the pairs I and III have, in the past, proved to be the most troublesome, while the pairs II and IV have not caused a great deal of problems. With the arrangement of the present invention, the crosstalk between pairs I and III is materially reduced, as shown in FIG. 9, which is a table of measured crosstalk performance for a standard 657C jack and for the staggered jack of the invention at 100 Mhz.

It is generally considered acceptable crosstalk performance when the crosstalk existing between discrete pairs is less than minus forty dB (−40 db). Inasmuch as we are dealing with negative values, minus sixty dB is less than minus forty dB (−60 dB<−40 dB). From the table of FIG. 9 it can be seen that the near end crosstalk between pairs I and II and I and IV is only slightly improved, but that between pairs I and III, usually the pairs most affected by crosstalk, is drastically reduced. The remaining pair combinations show more crosstalk than the standard plug, but in all cases the measured crosstalk is less than −40 dB. In any jack having multiple pairs, there is some crosstalk from all of the other pairs that affects each pair. Thus, the table of FIG. 8 also gives the power sum, for each pair, of all of the crosstalk existing therein. It can be seen that both pairs I and III, the pairs with which are formed inductive loops 56 and 57, there is a decrease in crosstalk, while pairs II and IV are substantially unchanged, but they do not exceed, however, the −40 dB limit.

Power sum is an ASTM D 4566 measurement and computation method that is commonly used to characterize Near End Crosstalk (NEXT) for cabling carrying multiple signals. It assumes that all pairs except the pair under test are energized and couple unwanted cross-talk energy into the pair under test simultaneously. This characterization is more stringent than pair-to-pair NEXT requirements. It is important that Power Sum performance is maintained end-to-end over all components used in a link or channel.

In concluding the detailed description, it should be noted that it will be obvious to those skilled in the art that many variations and modifications may be made to the preferred embodiment without substantially departing from the principles of the invention. All such variations and modifications are intended to be included herein as being within the scope of the present invention, as set forth in the claims. Further, in the claims, the corresponding structure, materials, acts, and equivalents of all means or step plus function elements are intended to include any structure, material, or acts for performing the functions with other claimed elements as specifically set forth.

I claim:

1. A connector jack assembly having a plurality of input terminals and a plurality of output terminals and interconnection apparatus for electrically interconnecting the input and output terminals comprising:

a dielectric block member having a front end and a rear end;

said interconnection apparatus comprising first and second conductor lead frames, each having a plurality of conductors that individually connect one predetermined input terminal with one predetermined output terminal;

first conductor supports on said dielectric block member for supporting the conductors of said first conductor lead frame at a first level;

second conductor supports on said dielectric block member for supporting the conductors of said second conductor lead frame at a second level spaced from said first level, the conductors of said first and second conductor lead frames forming at least two conductor pairs wherein one of the conductors of each of said two conductors pairs is supported at said first level and the other conductor of each of said two conductor pairs is supported at said second level to form an inductive loop in conjunction with said one conductor of the corresponding conductor pair;

two additional conductors of said first conductor lead frame forming a third conductor pair, both of the conductors of which are supported at said first level; and two additional conductors of said second conductor lead frame forming a fourth conductor pair, both of the conductors of which are supported at said second level.

2. A connector jack assembly as claimed in claim 1 wherein said first conductor supports comprises at least two spaced lands on said dielectric block, each land having a conductor supporting surface and said second support means comprises grooves between said lands spaced from said conductor supporting surface.

3. A connector jack assembly as claimed in claim 1 wherein said first conductor lead frame has four spaced parallel conductors 1, 2, 4, and 6 extending therealong and said second conductor lead frame has four spaced parallel conductors, 3, 5, 7, and 8 extending therealong where conductors 1 and 2 form a conductor pair II, conductors 3 and 6 form a conductor pair III, conductors 4 and 5 form a conductor pair I, and conductors 7 and 8 form a conductor pair IV, and wherein conductor 3 is supported at said second level and conductor 6 is supported at said first level to create an inductive loop in pair III, and conductor 4 is supported at said first level and conductor 5 is supported at said second level to create an inductive loop in pair I for interaction with the inductive loop in pair III.

4. The connector jack assembly as claimed in claim 3 wherein conductor 1 and conductor 2 are supported at said first level.

5. The connector jack assembly as claimed in claim 4 wherein conductor 7 and conductor 8 are supported at said second level.

6. For use in a connector jack assembly having a plurality of input terminals and a plurality of output terminals and interconnection apparatus for electrically connecting the input and output terminals and the interconnection apparatus comprises first and second conductor lead frames, each having a plurality of conductors that individually connect one predetermined input terminal with one predetermined output terminal;

a dielectric block assembly having a first block member and a substantially identical second block member;

said first block member and said second block member each having a plurality of spaced parallel ridges, each of said ridges having a conductor contacting surface thereon against which at least some of the conductors of the first and second lead frames are adapted to be in contact;

said spaced parallel ridges being separated from each other by grooves having conductor receiving surfaces;

said first and second block members being adapted to mesh together to form said dielectric block assembly, with the ridges of each block member fitting within the grooves of the other block member.

7. A dielectric block assembly as claimed in claim 6 and further including means for latching together said first block member and said second block member.

8. A dielectric block assembly as claimed in claim 6 wherein one of said ridges has a surface thereon for receiving two of the conductors of one of the lead frames and means for maintaining them in spaced, parallel relationship.

9. A dielectric block assembly as claimed in claim 6 wherein said conductor contacting surfaces define a first conductor level and said conductor receiving surfaces define a second conductor level.

10. A dielectric block assembly as claimed in claim 9 wherein each of said block members has a surface at said second conductor level for receiving two of the conductors of one of the lead frames and means for maintaining them in spaced, parallel relationship.

11. For use in an electrical connector, a connector jack assembly comprising:

a dielectric block member having first and second ends;

a plurality of conductors mounted on said dielectric block member and extending substantially parallel to each other from said first end to said second end, said plurality of conductors comprising at least four pairs of conductors, each of said pairs having a first conductor and a second conductor;

the first and second conductors of a first one of said pairs extending along said block at a first, upper, level;

the first conductor of a second one of said pairs extending along said block at said first level and the second conductor of said second one of said pairs extending along said block at a second, lower, level, said first level and said second level being spaced apart sufficient to allow said first and second conductors of said second pair to form an inductive loop.

12. A conductor jack assembly as claimed in claim 11 wherein the first conductor of a third one of said pairs extends along said block at said first level and the second conductor of said third one of said pairs extends along said block at said second level to form an inductive loop, said second and third pairs being positioned on said block to cause said inductive loops to interact with each other.

13. A connector jack assembly as claimed in claim 11 wherein said first and second conductors of another one of said pairs extend along said block at said second level.

14. A connector jack assembly as claimed in claim 12 wherein said first and second conductors of a fourth one of said pairs extend along said block at said second level.

15. For use in an electrical connector, a connector jack assembly comprising:

a dielectric block having first and second ends;

a plurality of conductors mounted on said dielectric block member and extending substantially parallel to each other over at least a portion of their length from said first end to said second end, said plurality of conductors comprising at least four pairs of conductors, each of said pairs having a first conductor and a second conductor;

the first conductor of a first one of said pairs extending along said block at a first level and the second conductor of said first one of said pairs extending along said block at a second level, said first level and said second level being spaced apart sufficient to allow said first and second conductors of said first pair to form an inductive loop;

the first conductor of a second one of said pairs extending along said block at said first level and the second conductor of said second one of said pairs extending along said block at said second level to form an inductive loop, said first and second pairs being positioned on said block to cause said inductive loops to interact with each other; and the first and second conductors of a third pair of conductors extending along said block, said first conductor being at said first level and said second conductor being a level which is different than said second level.

16. A connector jack assembly as claimed in claim 15 and further including a fourth pair of conductors, the first conductor of said fourth pair being at said second level and the second conductor being at a level which is different than said first level.

* * * * *